US011480985B2

(12) United States Patent
Zhong et al.

(10) Patent No.: US 11,480,985 B2
(45) Date of Patent: Oct. 25, 2022

(54) LOW-POWER VOLTAGE REGULATOR WITH FAST TRANSIENT RESPONSE

(71) Applicant: QUALCOMM Incorporated, San Diego, CA (US)

(72) Inventors: Xiaopeng Zhong, San Diego, CA (US); Masoud Roham, San Diego, CA (US)

(73) Assignee: QUALCOMM INCORPORATED, San Diego, CA (US)

( * ) Notice: Subject to any disclaimer, the term of this patent is extended or adjusted under 35 U.S.C. 154(b) by 0 days.

(21) Appl. No.: 17/154,865

(22) Filed: Jan. 21, 2021

(65) Prior Publication Data

US 2022/0229455 A1 Jul. 21, 2022

(51) Int. Cl.

| | |
|---|---|
| ***G05F 1/575*** | (2006.01) |
| ***G05F 1/46*** | (2006.01) |
| ***G05F 1/565*** | (2006.01) |
| ***G05F 1/445*** | (2006.01) |
| ***G05F 3/26*** | (2006.01) |

(52) U.S. Cl.
CPC ..... *G05F 1/575* (2013.01); *G05F 1/445* (2013.01); *G05F 1/461* (2013.01); *G05F 1/565* (2013.01); *G05F 3/262* (2013.01)

(58) Field of Classification Search
CPC ..... G05F 1/565; G05F 1/571; G05F 1/573
See application file for complete search history.

(56) References Cited

U.S. PATENT DOCUMENTS

| | | | |
|---|---|---|---|
| 7,982,448 B1 | 7/2011 | Prasad et al. | |
| 8,716,993 B2 | 5/2014 | Kadanka | |
| 8,810,219 B2 | 8/2014 | Suzuki | |
| 9,195,248 B2 | 11/2015 | Zegheru et al. | |
| 9,292,026 B2 | 3/2016 | Bhattad | |
| 10,938,381 B1 * | 3/2021 | Jiang | H03K 5/04 |
| 2009/0237048 A1 | 9/2009 | Hou et al. | |

(Continued)

FOREIGN PATENT DOCUMENTS

| | | | |
|---|---|---|---|
| CN | 108885474 A * | 11/2018 | G05F 1/56 |
| CN | 209980116 U * | 1/2020 | |

(Continued)

OTHER PUBLICATIONS

English translation of "CN209980116" Li Xiangnan "May 2019 , Low dropout linear regulator overshoot elimination circuit, undershoot elimination circuit and chip" (Year: 2019).*

(Continued)

*Primary Examiner* — Sisay G Tiku
(74) *Attorney, Agent, or Firm* — Chui-kiu Teresa Wong

(57) ABSTRACT

In certain aspects, a voltage regulator includes a pass device coupled between an input of the voltage regulator and an output of the voltage regulator. The voltage regulator also includes an amplifying circuit having a first input, a second input, and an output, wherein the first input is configured to receive a reference voltage, the second input is coupled to the output of the voltage regulator via a feedback path, and the output of the amplifying circuit is coupled to a gate of the pass device. The voltage regulator further includes a first current source coupled between a supply rail and the amplifying circuit, and a capacitor coupled between the first current source and the output of the voltage regulator.

15 Claims, 11 Drawing Sheets

(56) References Cited

U.S. PATENT DOCUMENTS

| | | | | |
|---|---|---|---|---|
| 2013/0147448 | A1* | 6/2013 | Kadanka | G05F 1/565 323/280 |
| 2019/0146531 | A1* | 5/2019 | Yung | G05F 1/563 363/21.01 |
| 2020/0081470 | A1 | 3/2020 | Hallikainen | |
| 2020/0150703 | A1* | 5/2020 | Chang | G05F 1/56 |
| 2021/0149426 | A1* | 5/2021 | Kim | G05F 1/56 |
| 2021/0255652 | A1* | 8/2021 | Yang | G05F 1/59 |

FOREIGN PATENT DOCUMENTS

| | | | | | |
|---|---|---|---|---|---|
| CN | 209980116 | U | | 1/2020 | |
| CN | 108459644 | B | * | 10/2020 | G05F 1/561 |
| WO | WO-2021133162 | A1 | * | 7/2021 | |
| WO | WO-2021216202 | A1 | * | 10/2021 | H03K 17/166 |

OTHER PUBLICATIONS

International Search Report and Written Opinion—PCT/US2022/011712—ISA/EPO—dated Apr. 19, 2022.

* cited by examiner

LOW-POWER VOLTAGE REGULATOR WITH FAST TRANSIENT RESPONSE

BACKGROUND

Field

Aspects of the present disclosure relate generally to voltage regulators, and more particularly, to low dropout (LDO) regulators.

Background

Voltage regulators are used in a variety of systems to provide regulated voltages to power circuits in the systems. A commonly used voltage regulator is a low dropout (LDO) regulator. An LDO regulator typically includes a pass device and an amplifying circuit coupled in a feedback loop to provide a regulated output voltage based on a reference voltage.

SUMMARY

The following presents a simplified summary of one or more implementations in order to provide a basic understanding of such implementations. This summary is not an extensive overview of all contemplated implementations and is intended to neither identify key or critical elements of all implementations nor delineate the scope of any or all implementations. Its sole purpose is to present some concepts of one or more implementations in a simplified form as a prelude to the more detailed description that is presented later.

A first aspect relates to a voltage regulator. The voltage regulator includes a pass device coupled between an input of the voltage regulator and an output of the voltage regulator. The voltage regulator also includes an amplifying circuit having a first input, a second input, and an output, wherein the first input is configured to receive a reference voltage, the second input is coupled to the output of the voltage regulator via a feedback path, and the output of the amplifying circuit is coupled to a gate of the pass device. The voltage regulator also includes a first current source coupled between a supply rail and the amplifying circuit, and a capacitor coupled between the first current source and the output of the voltage regulator.

A second aspect relates to a method of operating a voltage regulator. The voltage regulator includes a pass device coupled between an input of the voltage regulator and an output of the voltage regulator, and an amplifying circuit coupled to a gate of the pass device. The method includes detecting a transient voltage drop at the output of the voltage regulator via a capacitor, and increasing a bias current to the amplifying circuit based on the detected transient voltage drop.

A third aspect relates to a chip. The chip includes a pad, a supply rail, a reference circuit configured to generate a reference voltage, and a voltage regulator. The voltage regulator includes a pass device coupled between an input of the voltage regulator and an output of the voltage regulator, wherein the input of the voltage regulator is coupled to the supply rail. The voltage regulator also includes an amplifying circuit having a first input, a second input, and an output, wherein the first input is coupled to the reference circuit, the second input is coupled to the output of the voltage regulator via a feedback path, and the output of the amplifying circuit is coupled to a gate of the pass device. The voltage regulator further includes a first current source coupled between the supply rail and the amplifying circuit, and a capacitor coupled between the first current source and the output of the voltage regulator.

DETAILED DESCRIPTION

The detailed description set forth below, in connection with the appended drawings, is intended as a description of various configurations and is not intended to represent the only configurations in which the concepts described herein may be practiced. The detailed description includes specific details for the purpose of providing a thorough understanding of the various concepts. However, it will be apparent to those skilled in the art that these concepts may be practiced without these specific details. In some instances, well-known structures and components are shown in block diagram form in order to avoid obscuring such concepts.

A voltage regulator may be used to provide a circuit block with a supply voltage that is different from a main supply voltage and/or convert a noisy supply voltage into a clean supply voltage.

Figure 1:
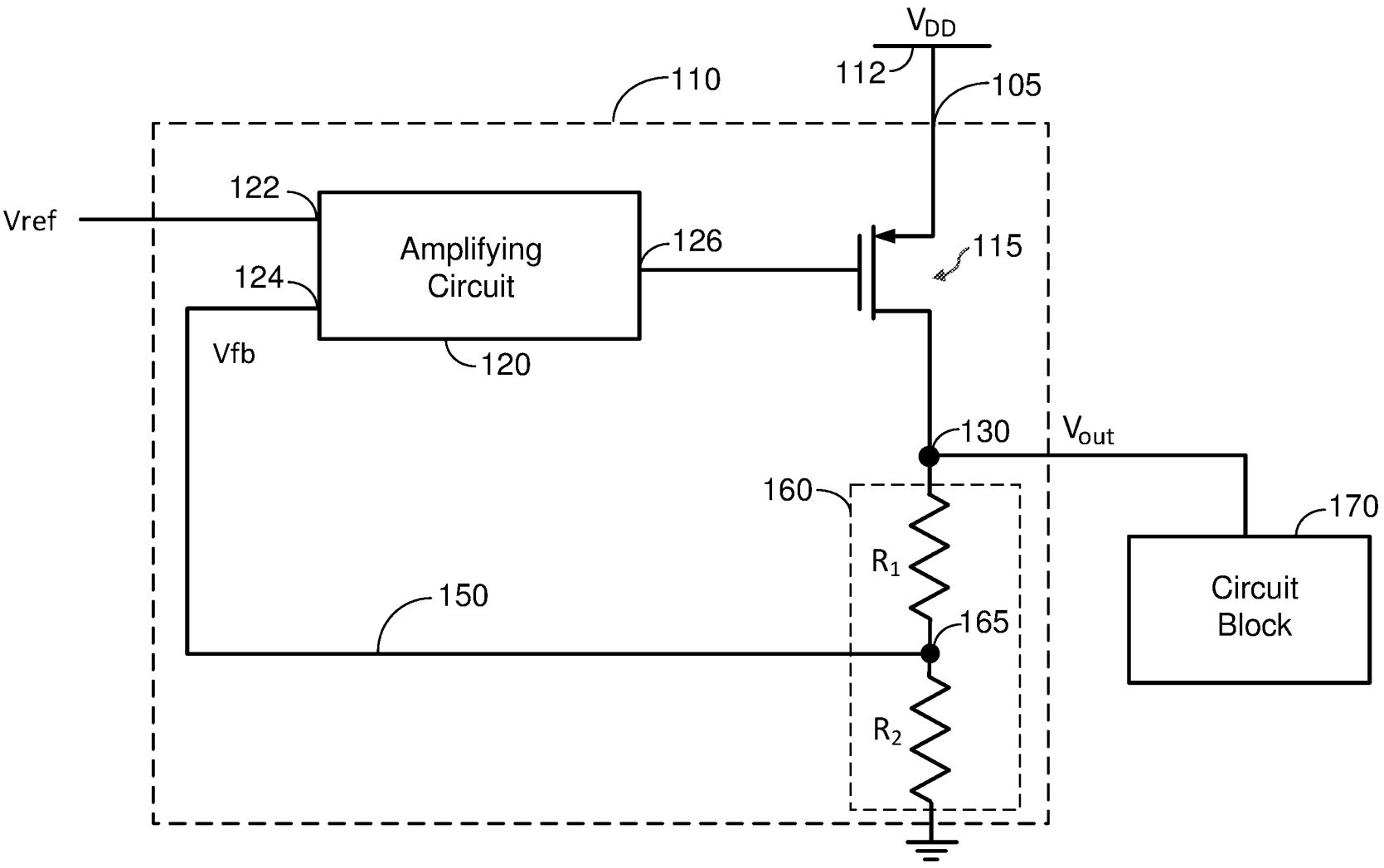
FIG. 1 shows an example of a low dropout (LDO) regulator.

A commonly used voltage regulator is the low dropout (LDO) regulator, an example of which is shown in FIG. 1. The exemplary LDO regulator 110 shown in FIG. 1 has an input 105 coupled to a voltage supply rail 112 and an output 130 coupled to a circuit block 170. The LDO regulator 110 is configured to convert the supply voltage $V_{DD}$ on the supply rail 112 into a regulated output voltage $V_{out}$ at the output 130 of the LDO regulator 110.

The LDO regulator 110 includes a pass device 115 coupled between the input 105 and the output 130 of the LDO regulator 110. In the example in FIG. 1, the pass device 115 is implemented with a p-type field effect transistor (PFET) having a source coupled to the input 105 and a drain coupled to the output 130. However, it is to be appreciated that the pass device 115 may be implemented with another type of transistor (e.g., n-type field effect transistor (NFET)) in other implementations. It is also to be appreciated that the pass device 115 may be implemented with multiple transistors coupled in parallel.

The LDO regulator 110 also includes an amplifying circuit 120 having an output 126 coupled to the gate of the pass device 115, a first input 122 coupled to a reference voltage $V_{ref}$, and a second input 124 coupled to the output 130 through a feedback path 150. The reference voltage $V_{ref}$ may be provided by a bandgap reference circuit or another type of circuit. The LDO regulator 110 may also include a voltage divider 160 coupled between the output 130 and ground. In the example in FIG. 1, the voltage divider 160 includes a first feedback resistor $R_1$ and a second feedback resistor $R_2$ coupled in series between the output 130 and ground. In this example, the second input 124 of the amplifying circuit 120 is coupled to a node 165 between the first feedback resistor $R_1$ and the second feedback resistor $R_2$. The voltage divider 160 is configured to generate a feedback voltage $V_{fb}$ at the node 165, which is fed to the second input 124 of the amplifying circuit 120. The feedback voltage $V_{fb}$ is proportional to the output voltage $V_{out}$ of the LDO regulator 110 and is given by the following:

$$V_{fb} = \left(\frac{R_2}{R_2 + R_1}\right)V_{out}. \tag{1}$$

where $R_1$ is the resistance of the first feedback resistor $R_1$ and $R_2$ is the resistance of the second feedback resistor $R_2$.

In operation, the amplifying circuit 120 adjusts the gate voltage of the pass device 115 in a direction that reduces the difference (i.e., error) between the reference voltage $V_{ref}$ and the feedback voltage $V_{fb}$. This forces the output voltage $V_{out}$ of the LDO regulator 110 to be approximately equal to the following:

$$V_{out} = \left(1 + \frac{R_1}{R_2}\right)V_{ref}. \tag{2}$$

Thus, the output voltage $V_{out}$ may be set to a desired voltage by setting the resistances of the feedback resistors $R_1$ and $R_2$ and/or setting the reference voltage $V_{ref}$ accordingly.

Figure 2:
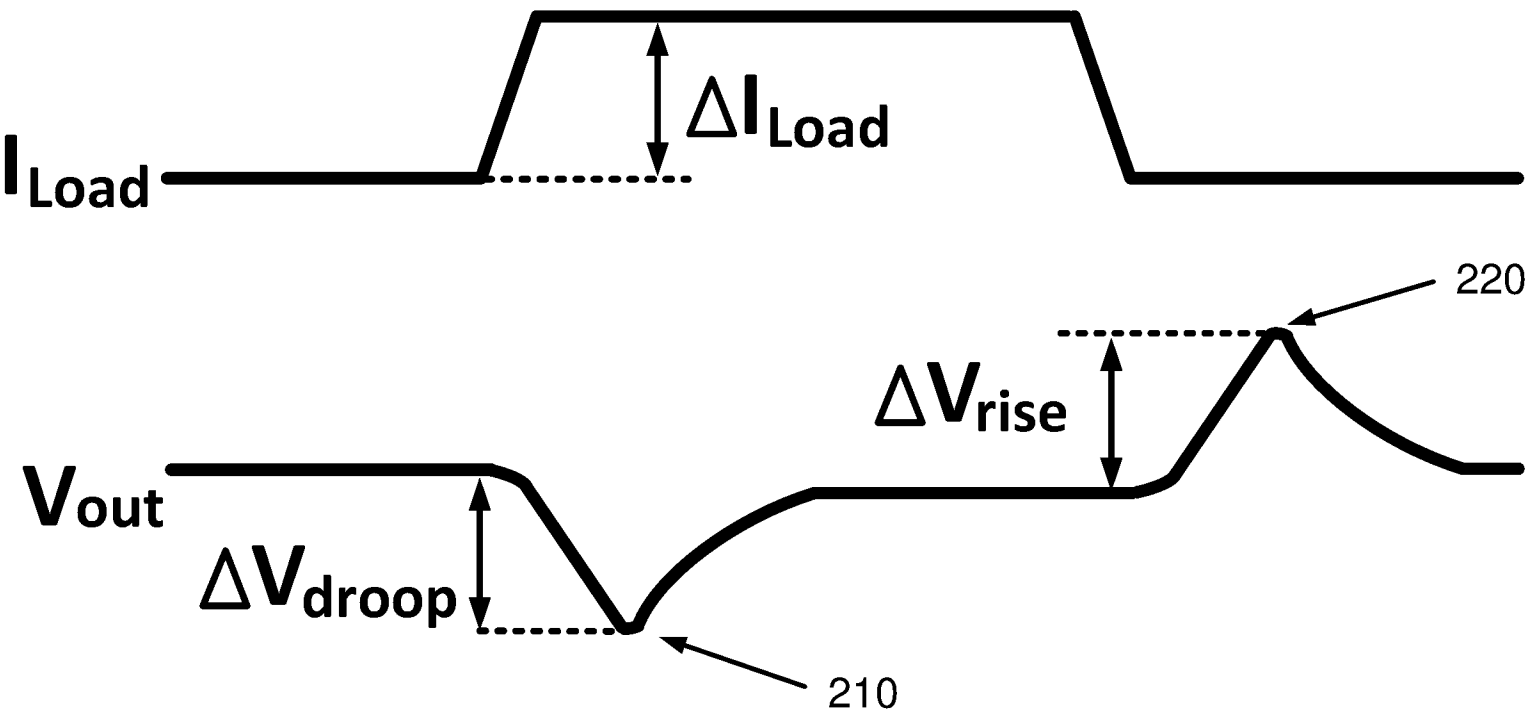
FIG. 2 shows an example of fluctuations in the output voltage of an LDO regulator caused by load current changes according to certain aspects of the present disclosure.

The output voltage $V_{out}$ exhibits fluctuations during changes in the load current $I_{Load}$ (i.e., current drawn by the circuit block 170). In this regard, FIG. 2 shows an example of fluctuations in the output voltage $V_{out}$ caused by changes in the load current $I_{Load}$. In this example, the load current $I_{Load}$ rises by $\Delta I_{Load}$ and then falls by $\Delta I_{Load}$. This may occur, for example, when the circuit block 170 transitions from a standby state to an active state and then transitions from the active state back to the standby state.

As shown in FIG. 2, the rise in the load current $I_{Load}$ causes an undershoot 210 in the output voltage $V_{out}$ and the fall in the load current $I_{Load}$ causes an overshoot 220 in the output voltage $V_{out}$. It is desirable to reduce the undershoot and the overshoot in the output voltage $V_{out}$ (i.e., reduce fluctuations in the output voltage $V_{out}$) to ensure accurate performance of the circuit block 170.

A first approach to reduce fluctuations in the output voltage $V_{out}$ is to couple a large off-chip capacitor to the output 130 of the LDO regulator 110 to absorb load current changes. However, this approach increases area and cost. A second approach is to provide the amplifying circuit 120 with a large constant bias current to increase the loop bandwidth of the LDO regulator 110, which gives the LDO regulator 110 a faster transient response. The faster transient response allows the LDO regulator 110 to quickly reduce fluctuations in the output voltage $V_{out}$. However, the large constant bias current results in higher power consumption.

Figure 3:
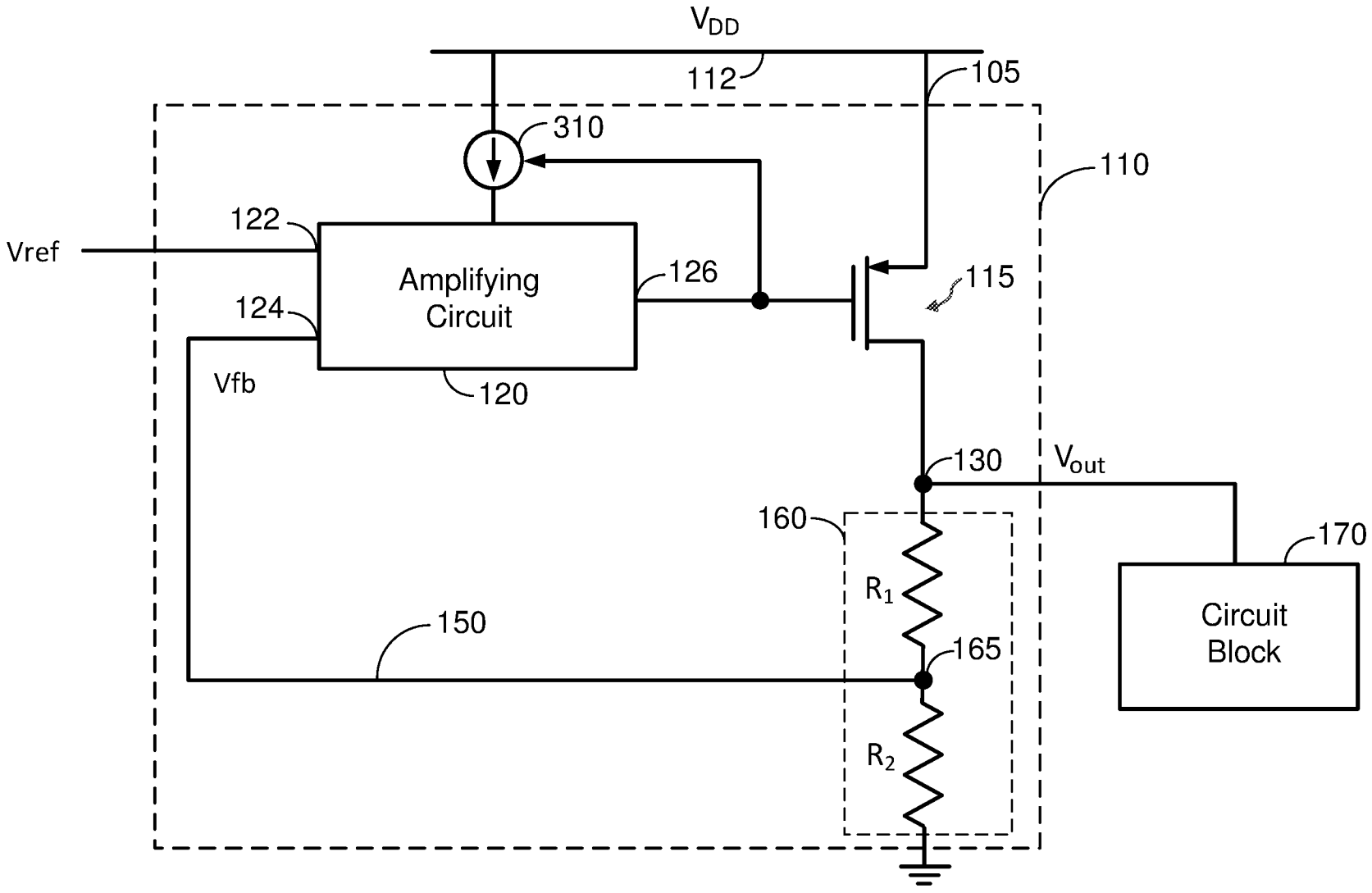
FIG. 3 shows an example of an LDO regulator with adaptive current biasing according to certain aspects of the present disclosure.

In another approach, the LDO regulator 110 uses adaptive current biasing, in which the bias current to the amplifying circuit 120 is adjusted based on the load current. In this regard, FIG. 3 shows an example of the LDO regulator 110 with adaptive current biasing according to certain aspects. In this example, the LDO regulator 110 includes a current source 310 coupled between the supply rail 112 and the amplifying circuit 120, in which the current source 310 is configured to provide a bias current to the amplifying circuit 120. The current source 310 is also coupled to the gate of the pass device 115. The current source 310 is configured to sense the load current from the gate voltage of the pass device 115 and adjust the bias current to the amplifying circuit 120 based on the sensed load current. In certain aspects, the current source 310 is configured to increase the bias current when the sensed load current increases and decrease the bias current when the sensed load current decreases. By increasing the bias current when the sensed load current is high (i.e., heavy), the current source 310 increases the loop bandwidth (and hence decreases the transient response time) of the LDO regulator 110 when the sensed load current is high.

Figure 4:
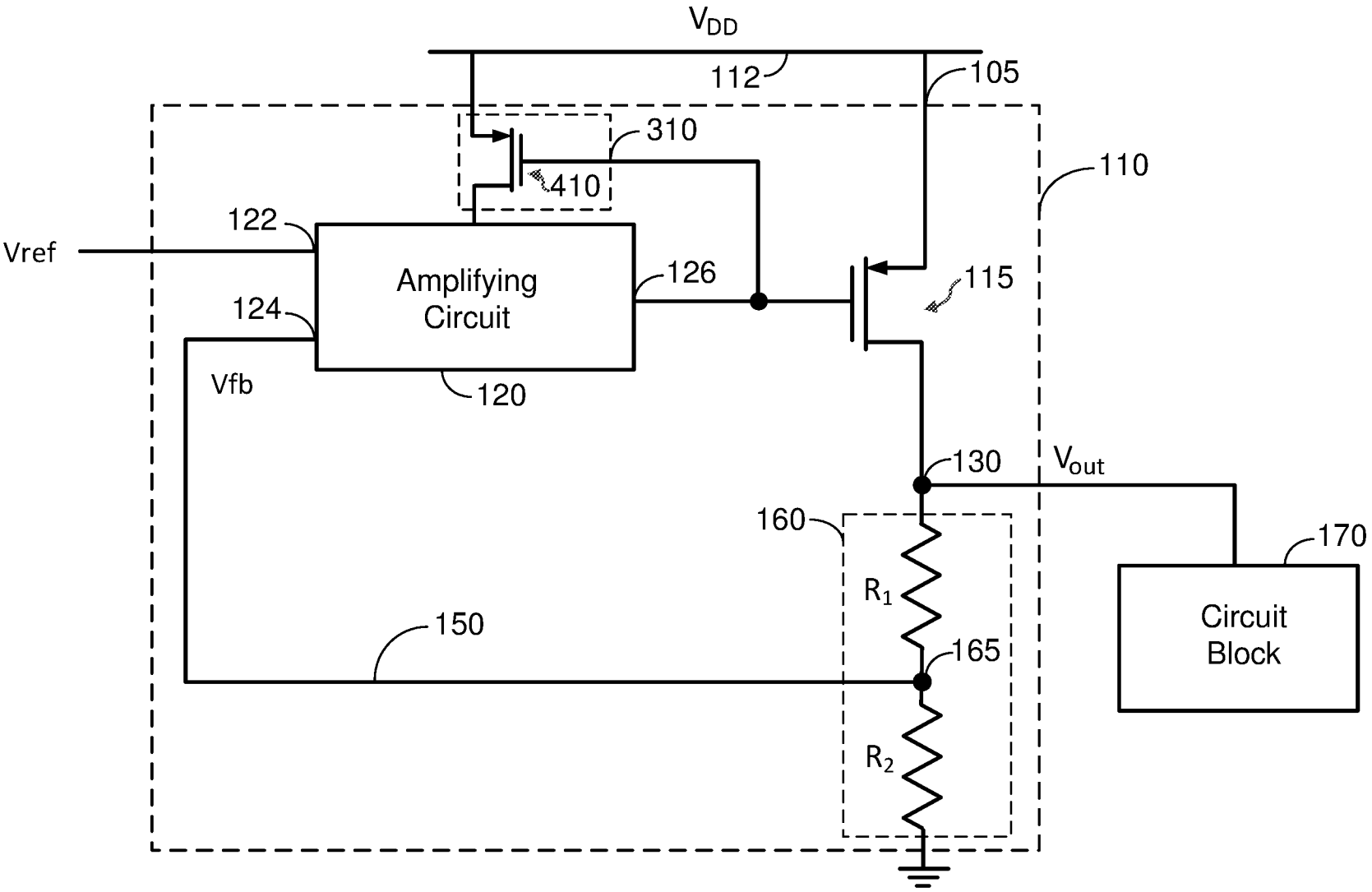
FIG. 4 shows an exemplary implementation of an adaptive current source according to certain aspects of the present disclosure.

FIG. 4 shows an exemplary implementation of the current source 310 according to certain aspects. In this example, the current source 310 includes a transistor 410 coupled between the supply rail 112 and the amplifying circuit 120. In the example in FIG. 4, the transistor 410 is implemented with a PFET having a source coupled to the supply rail 112 and a drain coupled to the amplifying circuit 120. However, it is to be appreciated that the transistor 410 may be implemented with another type of transistor in other implementations. It is also to be appreciated that the transistor 410 may include multiple transistors coupled between the supply rail 112 and the amplifying circuit 120. In this example, the gate of the transistor 410 is coupled to the gate of the pass device 115, which allows the transistor 410 to sense the load current from the gate voltage of the pass device 115 and adjust the bias current based on the sensed load current.

Adaptive current biasing is advantageous over the first approach by eliminating the need for the large off-chip capacitor used in the first approach. In addition, adaptive current biasing decreases the bias current when the sensed load current is light, which may occur, for example, when the circuit block 170 is in a standby state. The decreased bias current during light load current reduces power consumption compared with the second approach which uses a large constant bias current.

Figure 5:
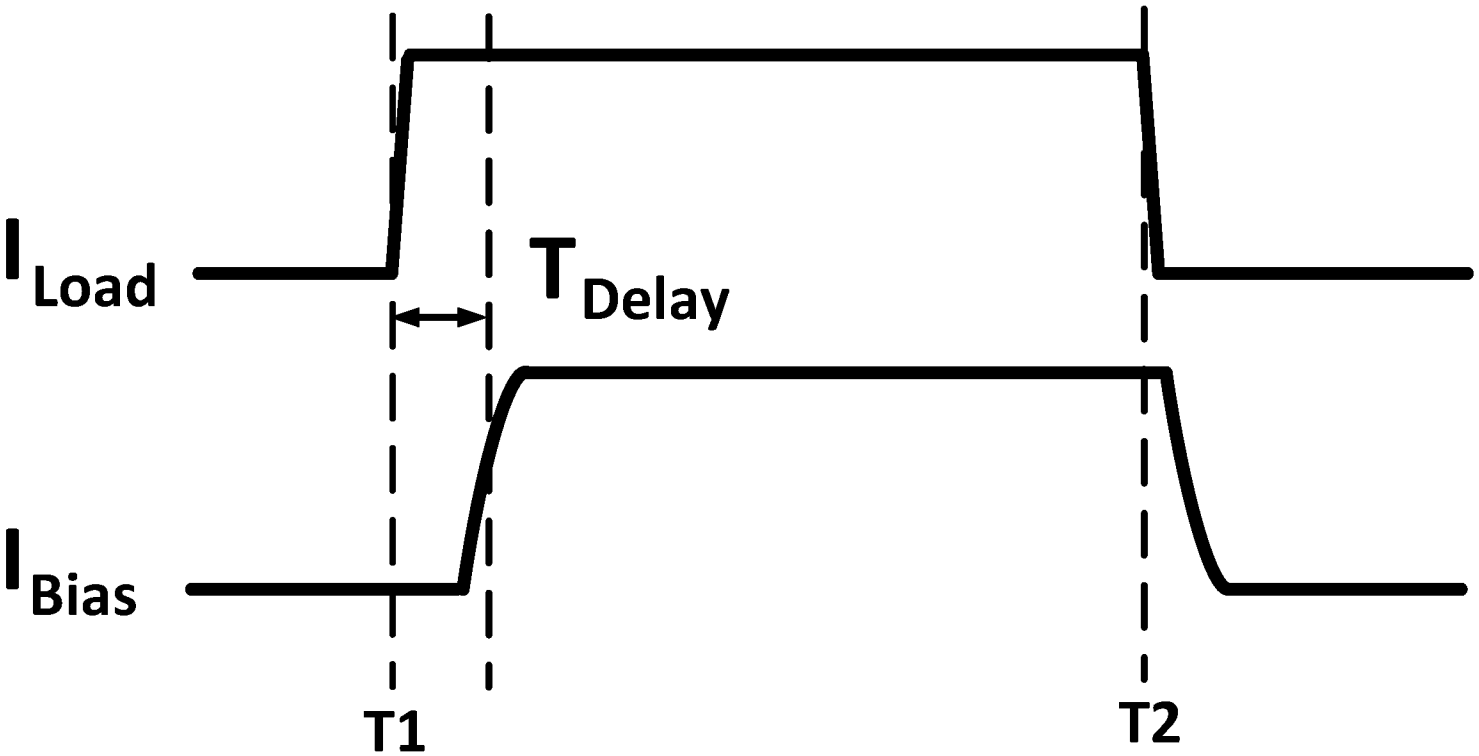
FIG. 5 shows an example of response times for adaptive current biasing according to certain aspects of the present disclosure.

However, adaptive current biasing may not provide enough reduction in voltage undershoot caused by a change in the load current from a light load to a heavy load. An example of this is illustrated in FIG. 5, which shows an example of the bias current $I_{Bias}$ and the load current $I_{Load}$. In this example, the load current $I_{Load}$ rises at time T1 and falls at time T2.

Before time T1, the load current $I_{Load}$ is low (i.e., light). As a result, the bias current $I_{Bias}$ is also low, which reduces the loop bandwidth (and hence increases the transient response time) of the LDO regulator 110. At time T1, the load current $I_{Load}$ rises, causing a voltage undershoot (e.g., undershoot 210) in the output voltage $V_{out}$. As shown in FIG. 5, at the start of the voltage undershoot, the bias current $I_{Bias}$ is initially low and hence the loop bandwidth of the LDO regulator 110 is initially small. This is because the current source 310 senses the change in the load current $I_{Load}$ from the gate voltage of the pass device 115. Since the response of the gate voltage to changes in the load current $I_{Load}$ is limited by the loop bandwidth of the LDO regulator 110 (which is initially small), there is a relatively long delay $T_{Delay}$ between the rise in the load current $I_{Load}$ and the increase in the bias current $I_{Bias}$. The initial small loop bandwidth (and hence initial slow transient response) of the LDO regulator 110 can lead to a large output voltage undershoot.

At time T2, the load current $I_{Load}$ falls, causing a voltage overshoot (e.g., overshoot 220) in the output voltage $V_{out}$. As shown in FIG. 5, at the start of the voltage overshoot, the bias current $I_{Bias}$ is initially high and hence the loop bandwidth of the LDO regulator 110 is initially large. As a result, the LDO regulator 110 can quickly respond to the fall in the load current $I_{Load}$ and therefore substantially reduce the voltage overshoot.

Thus, while adaptive current biasing substantially reduces voltage overshoot, adaptive current biasing may not provide adequate reduction in voltage undershoot due to the initial small loop bandwidth of the LDO regulator 110 when the load current $I_{Load}$ changes from a light load to a heavy load.

To address this, aspects of the present disclosure provide dynamic current biasing to reduce undershoot in the output voltage $V_{out}$ caused by changes in the load current $I_{LOAD}$ from a light load to a heavy load, as discussed further below. Dynamic current biasing according to aspects of the present disclosure may be used in combination with adaptive current biasing or may be used without adaptive current biasing.

Figure 6:
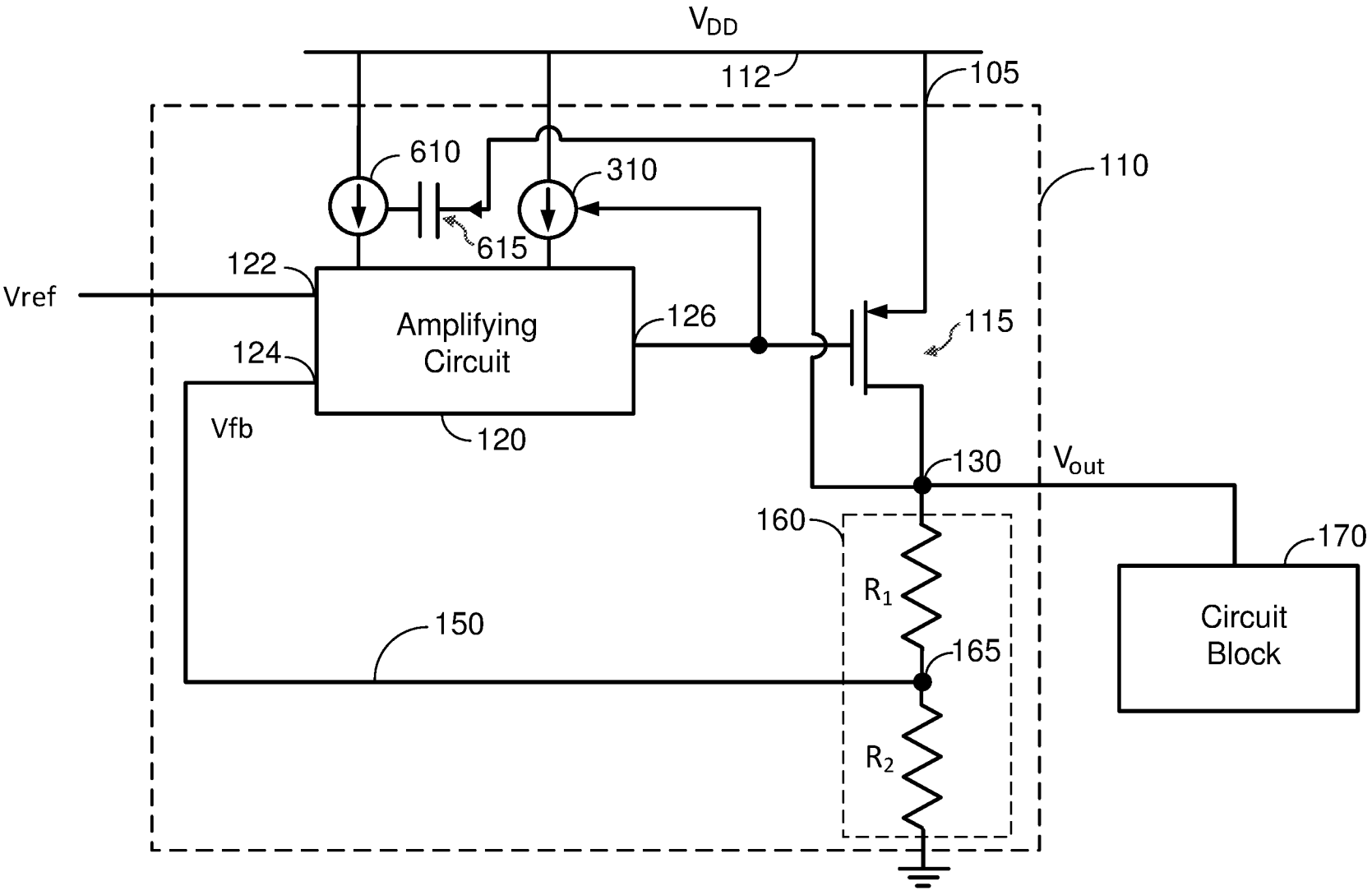
FIG. 6 shows an LDO regulator with dynamic current biasing and adaptive current biasing according to certain aspects of the present disclosure.

FIG. 6 shows an example of the LDO regulator 110 with dynamic current biasing according to certain aspects. In this example, the LDO regulator 110 also includes the current source 310 discussed above for adaptive current biasing. However, it is to be appreciated that the current source 310 may be omitted in some implementations.

In this example, the LDO regulator 110 also includes a bias current source 610 and a feedback capacitor 615 for providing dynamic current biasing. In the discussion below, the bias current source 610 is referred to as the first bias current source 610 and the bias current source 310 is referred to as the second bias current source 310.

The first current source 610 is coupled between the supply rail 112 and the amplifying circuit 120, in which the first current source 610 is configured to provide a bias current to the amplifying circuit 120. The feedback capacitor 615 is coupled between the first current source 610 and the output 130 of the LDO regulator 110. Thus, the first bias current source 610 is capacitively coupled to the output 130 of the LDO regulator 110 via the feedback capacitor 615. The capacitive coupling couples a transient voltage drop in the output voltage $V_{out}$ during a voltage undershoot to the first bias current source 610. This allows the first bias current source 610 to detect a transient voltage drop in the output voltage $V_{out}$ caused by a change in the load current $I_{Load}$ from a light load to a heavy load. The transient voltage drop may have a time duration between ten nanoseconds and one microsecond in certain aspects. The first bias current source 610 can quickly detect the transient voltage drop in the output voltage $V_{out}$ because the first bias current source 610 is capacitively coupled to the output 130 of the LDO regulator 110 through the feedback capacitor 615, which is not limited by the initially small loop bandwidth of the LDO regulator 110 discussed above. In contrast, the response time of adaptive current biasing is limited by the loop bandwidth of the LDO regulator 110 (which is initially small) because the second current source 310 detects an increase in the load current from the gate voltage of the pass device 115.

In response to a detected transient voltage drop in the output voltage $V_{out}$, the first current source 610 boosts (i.e., increases) the bias current to the amplifying circuit 120. The boosted bias current increases the loop bandwidth (i.e., reduces the transient response time) of the LDO regulator 110, which allows the LDO regulator 110 to quickly respond to the voltage undershoot and therefore reduce the voltage undershoot.

Thus, the first bias current source 610 and the feedback capacitor 615 provide the LDO regulator 110 with a fast transient response to a voltage undershoot by quickly boosting the bias current to the amplifying circuit 120 in response to a transient drop in the output voltage $V_{out}$. Adaptive current biasing may also be helpful during the voltage undershoot. This is because, during a transition from a light load current to a heavy load current, adaptive biasing helps boost the loop bandwidth as the load current increases.

In the example shown in FIG. 6, dynamic current biasing is used in combination with adaptive current biasing. In this example, the dynamic current biasing may be used to reduce voltage undershoot caused by a change in the load current from a light load to a heavy load and the adaptive current biasing may be used to reduce voltage overshoot caused by a change in the load current from a heavy load to a light load. However, it is to be appreciated that the dynamic current biasing may be used without the adaptive current biasing in some implementations (e.g., for the case where voltage overshoot is not an issue or voltage overshoot is mitigated by another technique). In these implementations, the second current source 310 may be omitted.

Figure 7:
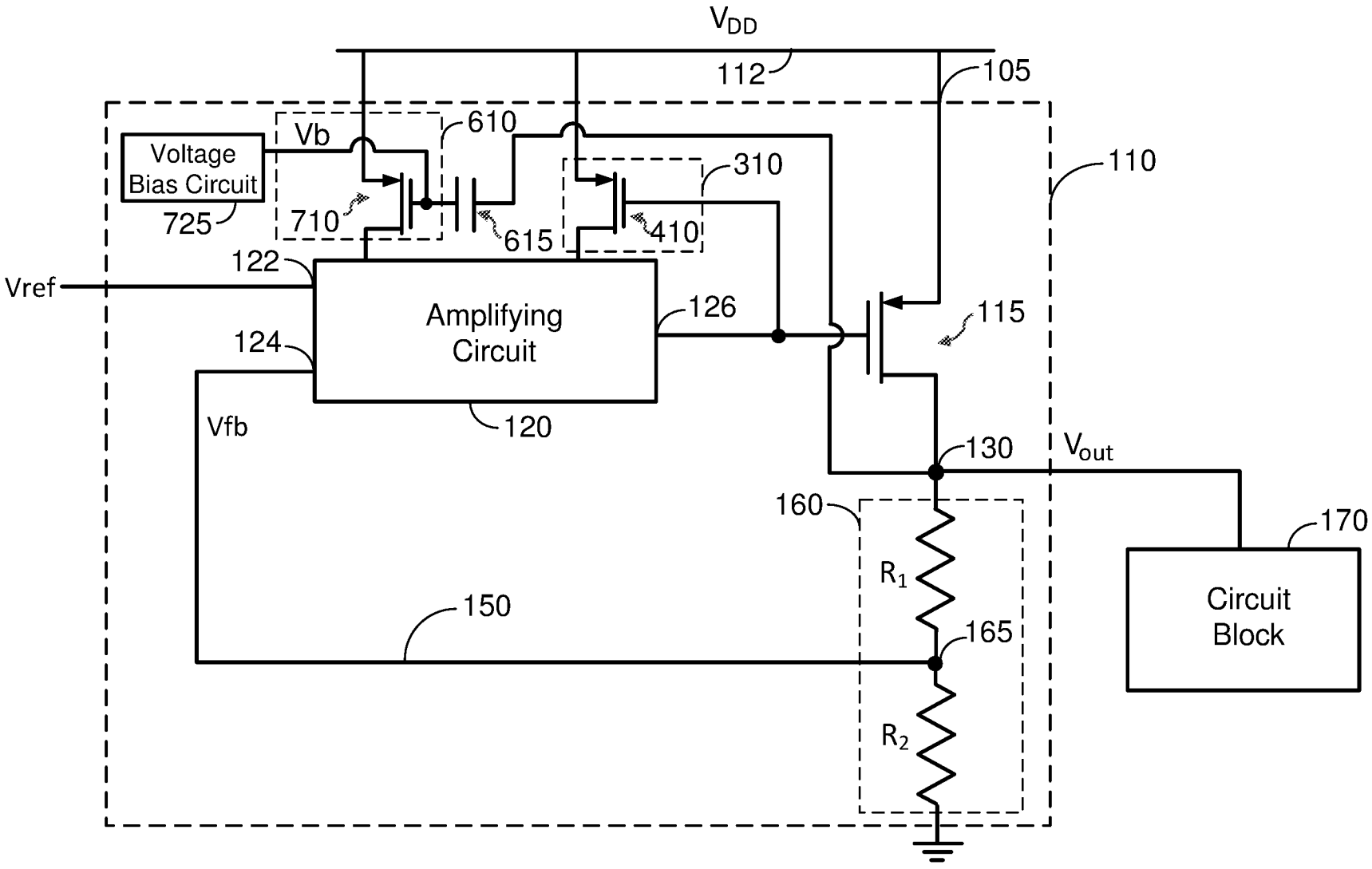
FIG. 7 shows an exemplary implementation of a current source used for dynamic current biasing according to certain aspects of the present disclosure.

FIG. 7 shows an exemplary implementation of the first current source 610 according to certain aspects. In this example, the first current source 610 includes a transistor 710 coupled between the supply rail 112 and the amplifying circuit 120. In the example in FIG. 7, the transistor 710 is implemented with a PFET having a source coupled to the supply rail 112 and a drain coupled to the amplifying circuit 120. However, it is to be appreciated that the transistor 710 may be implemented with another type of transistor in other implementations. It is also to be appreciated that the transistor 710 may include multiple transistors coupled between the supply rail 112 and the amplifying circuit 120. Also, in this example, the second current source 310 is implemented with the transistor 410 discussed above with reference to FIG. 4.

In the example in FIG. 7, the LDO regulator 110 also includes a voltage bias circuit 725 coupled to the gate of the transistor 710. In this example, the voltage bias circuit 725 is configured to generate a DC bias voltage Vb, which is applied to the gate of the transistor 710 to bias the gate of the transistor 710.

In this example, the feedback capacitor 615 is coupled between the gate of the transistor 710 and the output 130 of the LDO regulator 110. Thus, the gate of the transistor 710 is capacitively coupled to the output 130 of the LDO regulator 110 via the feedback capacitor 615. The capacitive coupling couples a transient voltage drop in the output voltage $V_{out}$ to the gate of the transistor 710 while blocking the bias voltage Vb from the output 130 of the LDO regulator 110. The transient voltage drop coupled to the gate of the transistor 710 through the feedback capacitor 615 causes the gate voltage of the transistor 710 to decrease from the bias voltage Vb. The decrease in the gate voltage causes the transistor 710 (which is implemented with a PFET in this example) to increase the bias current to the amplifying circuit 120. Thus, the transistor 710 increases the bias current to the amplifying circuit 120 in response to a transient voltage drop at the output 130 of the LDO regulator 110 caused by a transition of the load current from a light load to a heavy load.

Figure 8:
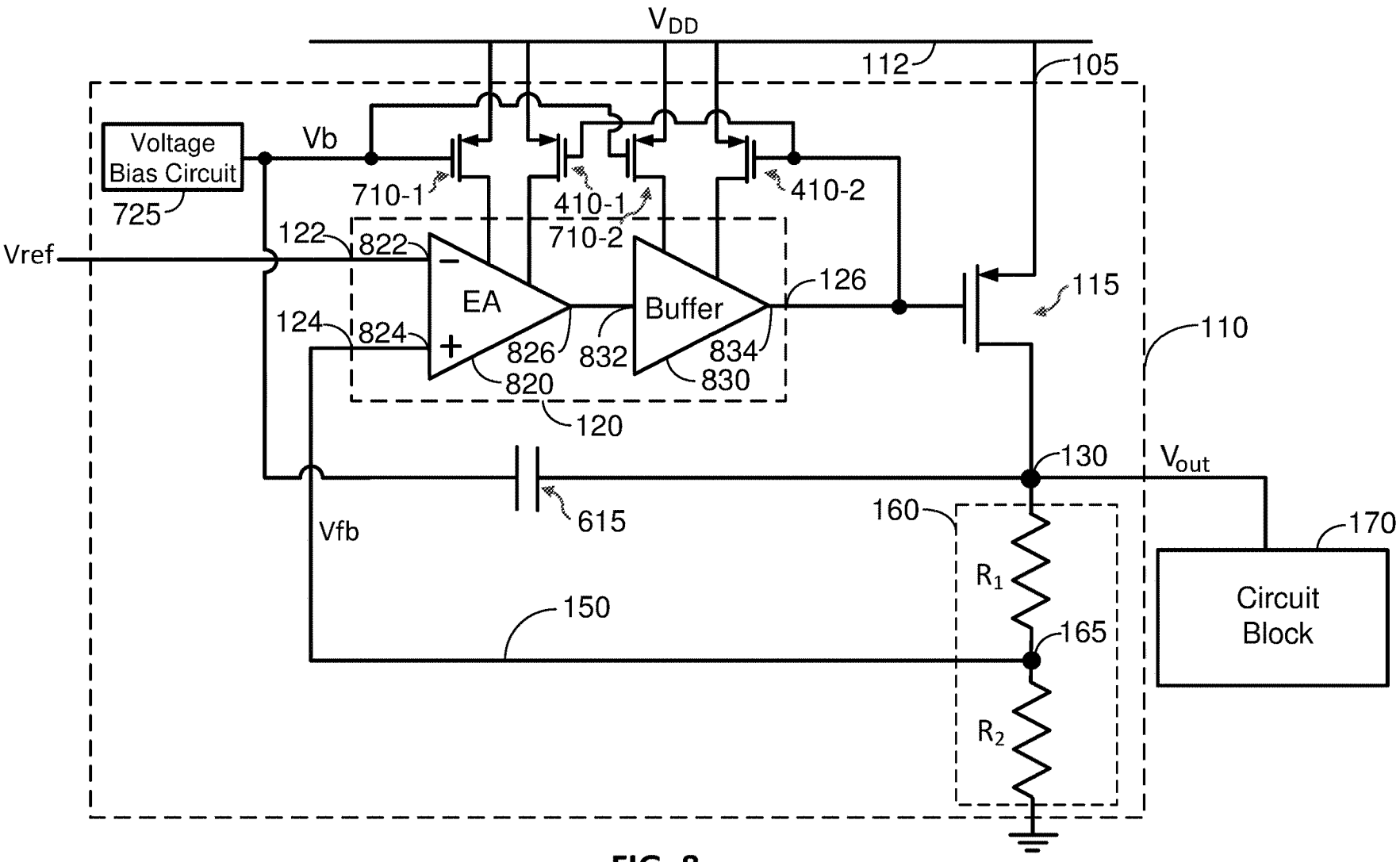
FIG. 8 shows an exemplary implementation of an amplifying circuit according to certain aspects of the present disclosure.

FIG. 8 shows an exemplary implementation of the amplifying circuit 120 according to certain aspects of the present disclosure. In this example, the amplifying circuit 120 includes an error amplifier 820 and an output buffer 830. The error amplifier 820 is configured to provide the amplifying circuit 120 with high gain and may have a high output impedance. The error amplifier 820 may be implemented with a cascode amplifier or another type of amplifier. The output buffer 830 is configured to provide low output impedance at the output 126 of the amplifying circuit 120 for driving the gate of the pass device 115. The output buffer 830 may be implemented with a source follower or another type of buffer circuit.

In the example in FIG. 8, the error amplifier 820 has a first input 822 (e.g., minus input) coupled to the reference voltage $V_{ref}$, a second input 824 (e.g., plus input) coupled to the output 130 through the feedback path 150, and an output 826. The output buffer 830 has an input 832 coupled to the output 826 of the error amplifier 820 and an output 834 coupled to the gate of the pass device 115.

In the example in FIG. 8, the transistor 410 shown in FIG. 7 includes a first transistor 410-1 coupled between the supply rail 112 and the error amplifier 820, and a second transistor 410-2 coupled between the supply rail 112 and the output buffer 830. In this example, the first transistor 410-1 is implemented with a PFET having a source coupled to the supply rail 112 and a drain coupled to the error amplifier 820, and the second transistor 410-2 is implemented with a PFET having a source coupled to the supply rail 112 and a drain coupled to the output buffer 830. However, it is to be appreciated that each of the transistors 410-1 and 410-2 may be implemented with another type of transistor in other implementations. The gate of each of the transistors 410-1 and 410-2 is coupled to the gate of the pass device 115 to sense the load current from the gate voltage of the pass device 115. In response to an increase in the sensed load current, the first transistor 410-1 increases the bias current to the error amplifier 820 and the second transistor 410-2 increases the bias current to the output buffer 830. Thus, in this example, the first transistor 410-1 provides adaptive current biasing for the error amplifier 820 and the second transistor 410-2 provides adaptive current biasing for the output buffer 830.

In the example in FIG. 8, the transistor 710 shown in FIG. 7 includes a first transistor 710-1 coupled between the supply rail 112 and the error amplifier 820, and a second transistor 710-2 coupled between the supply rail 112 and the output buffer 830. In the example in FIG. 8, the first transistor 710-1 is implemented with a PFET having a source coupled to the supply rail 112 and a drain coupled to the error amplifier 820, and the second transistor 710-2 is implemented with a PFET having a source coupled to the supply rail 112 and a drain coupled to the output buffer 830. However, it is to be appreciated that each of the transistors 710-1 and 710-2 may be implemented with another type of transistor in other implementations. In this example, the voltage bias circuit 725 is coupled to the gate of each of the transistors 710-1 and 710-2 to bias the gates of the transistors 710-1 and 710-2.

The feedback capacitor 615 is coupled between the output 130 and the gate of each of the transistors 710-1 and 710-2. Thus, the gate of each of the transistors 710-1 and 710-2 is capacitively coupled to the output 130 via the feedback capacitor 615. The capacitive coupling couples a transient voltage drop in the output voltage $V_{out}$ during a voltage undershoot to the gates of the transistors 710-1 and 710-2. In response to the transient voltage drop, the first transistor 710-1 boosts (i.e., increases) the bias current to the error amplifier 820 and the second transistor 710-2 boosts (i.e., increases) the bias current to the output buffer 830. Thus, in this example, the first transistor 710-1 provides dynamic current biasing for the error amplifier 820 and the second transistor 710-2 provides dynamic current biasing for the output buffer 830.

Figure 9:
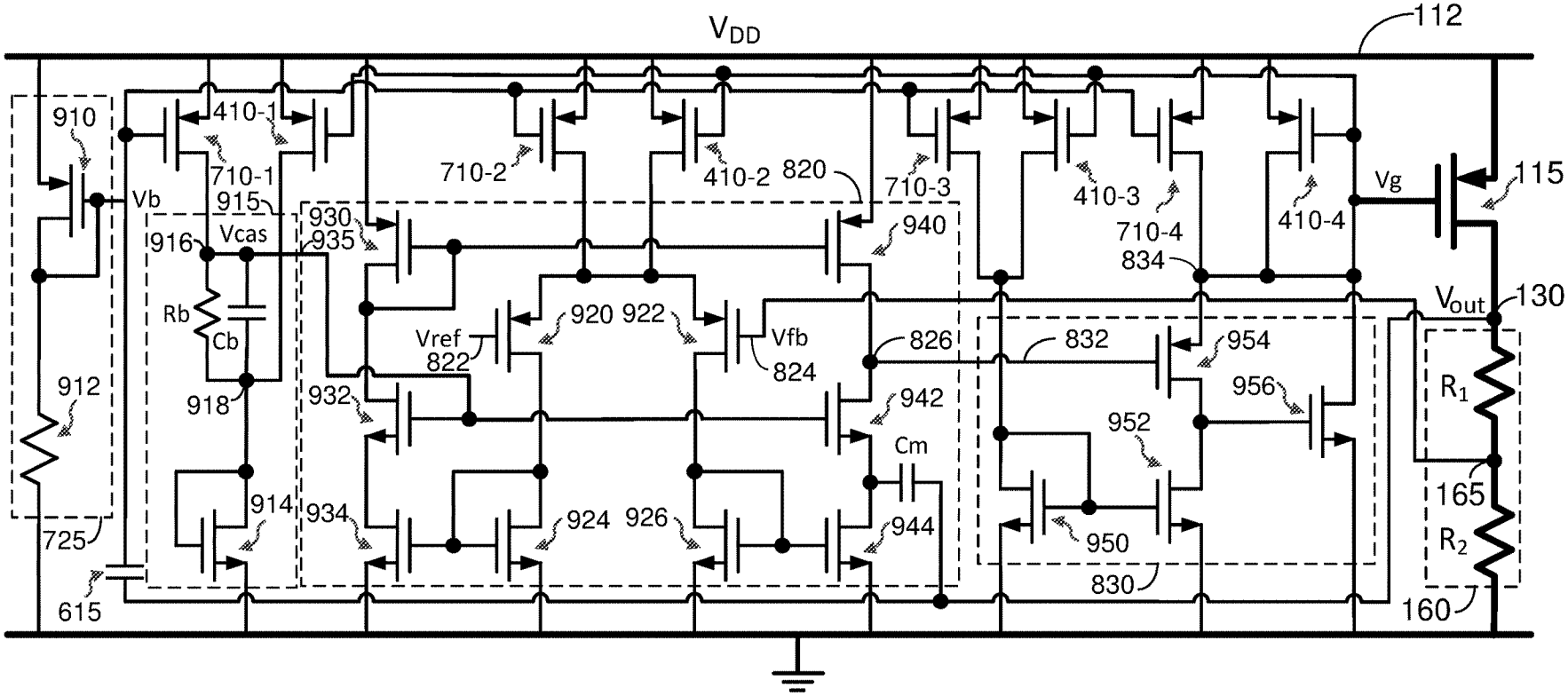
FIG. 9 shows an exemplary implementation of a bias circuit, an error amplifier, and a buffer according to certain aspects of the present disclosure.

FIG. 9 shows an exemplary implementation of the bias circuit 725, the error amplifier 820, and the output buffer 830 according to certain aspects. In this example, the bias circuit 725 includes a transistor 910 (e.g., PFET) and a resistor 912. The source of the transistor 910 is coupled to the supply rail 112, and the drain and the gate of the transistor 910 are coupled (i.e., tied) together. The resistor 912 is coupled between the drain of the transistor 910 and ground. In this example, the bias voltage Vb is generated at the gate of the transistor 910.

The error amplifier 820 includes a first input transistor 920 and a second input transistor 922. The gate of the first input transistor 920 is coupled to the first input 822 of the error amplifier 820, and the gate of the second input transistor 922 is coupled to the second input 824 of the error amplifier 820. Thus, the reference voltage $V_{ref}$ is applied to the gate of the first input transistor 920 and the feedback voltage $V_{fb}$ is applied to the gate of the second input transistor 922. In the example in FIG. 9, each of the input transistors 920 and 922 is implemented with a PFET. However, it is to be appreciated that each of the input transistors 920 and 922 may be implemented with another type of transistor (e.g., NFET).

The error amplifier 820 also includes transistors 924, 926, 930, 932, 934, 940, 942 and 944. Transistors 924 and 934 are coupled in a current-mirror configuration, in which the drain of transistor 924 is coupled to the drain of the first input transistor 920, and the gate of transistor 924 is coupled to the gate of transistor 934 and the drain of transistor 924. The sources of transistors 924 and 934 are coupled to ground. The source of transistor 932 is coupled to the drain of transistor 934 and the gate of transistor 932 is biased by bias voltage Vcas. Transistors 930 and 940 are coupled in a current-mirror configuration, in which the drain of transistor 930 is coupled to the drain of the transistor 932, and the gate of transistor 930 is coupled to the gate of transistor 940 and the drain of transistor 930. The drain of transistor 940 is coupled to the output 826 of the error amplifier 820.

Transistors 926 and 944 are coupled in a current-mirror configuration, in which the drain of transistor 926 is coupled to the drain of the second input transistor 922, and the gate of transistor 926 is coupled to the gate of transistor 944 and the drain of transistor 926. The sources of transistors 926 and 944 are coupled to ground. The source of transistor 942 is coupled to the drain of transistor 944, the gate of transistor 942 is biased by the bias voltage Vcas, and the drain of transistor 942 is coupled to the output 826 of the error amplifier 820.

In operation, the current from the first input transistor 920 flows through transistor 924 and is mirrored at the drain of transistor 934. The current of transistor 934 flows through transistor 932 and transistor 930, and is mirrored at the drain of transistor 940, which is coupled to the output 826. The current from the second input transistor 922 flows through transistor 926 and is mirrored at the drain of transistor 944. The current of transistor 944 flows through transistor 942 in which is coupled to the output 826. In this example, transistor 942 is coupled to transistor 944 in a cascode configuration, which increases the output impedance and gain of the error amplifier 820.

In this example, the LDO regulator 110 includes a bias generation circuit 915 configured to generate the bias voltage Vcas according to certain aspects. The bias generation circuit 915 includes a bias transistor 914, resistor Rb and capacitor Cb. Resistor Rb and capacitor Cb are coupled in parallel between node 916 and node 918, in which the bias voltage Vcas is generated at node 916. The drain of transistor 914 is coupled to node 918 and the gate of transistor 914, and the source of transistor 914 is coupled to ground. Node 916 is coupled to a bias input 935 of the amplifier 820, which is coupled to the gates of transistors 932 and 942. In this example, the resistance of resistor Rb is used to set the voltage difference between the gate of transistor 932 and the gate of transistor 934, and between the gate of transistor 942 and the gate of transistor 944. Capacitor Cb helps ensure that the voltage difference is maintained approximately constant under different adaptive biases.

In this example, the error amplifier 820 also includes a capacitor Cm coupled between the output 130 and the drain of transistor 944. The capacitor Cm acts as a Miller compensation capacitor for stability and enhances loop bandwidth during transient response.

In this example, the output buffer 830 includes transistors 950, 952, 954 and 956. The gate of transistor 954 is coupled to the input 832 of the output buffer 830 and the source of transistor 954 is coupled to the output 834 of the output buffer 830. As discussed further below, transistor 954 is configured as a source follower to provide the buffer 830 with a low output impedance.

Transistors 950 and 952 are coupled in a current-mirror configuration, in which the gate of transistor 950 is coupled to the gate of transistor 952 and the drain of transistor 950. The sources of transistors 950 and 952 are coupled to ground. The drain of transistor 952 is coupled to the drain of transistor 954. As discussed further below, transistor 950 receives a bias current, which is mirrored at the drain of transistor 952.

The gate of transistor 956 is coupled to the drain of transistor 954, the drain of transistor 956 is coupled to the output 834 of the buffer 830, and the source of transistor 956 is coupled to ground. In this example, transistor 956 is coupled with transistor 954 is a super source follower configuration that further reduces (i.e., attenuates) the output impedance of the buffer 830. The super source follower configuration reduces the output impedance to 1/(gm1*gm2*ro1) where gm1 is the transconductance of transistor 954, gm2 is the transconductance of transistor 956, and ro1 is the impedance of transistor 954. It is to be appreciated that transistors 952 and 956 may be omitted in some implementations. For implementations in which transistors 952 and 956 are omitted, the output impedance of the buffer 830 is approximately 1/gm1.

In the example in FIG. 9, the transistor 410 in FIG. 7 includes a first transistor 410-1 coupled between the supply rail 112 and the drain of transistor 914, a second transistor 410-2 coupled between the supply rail 112 and the sources of the input transistors 920 and 922, a third transistor 410-3 coupled between the supply rail 112 and the drain of transistor 950, and a fourth transistor 410-4 coupled between the supply rail 112 and the source of transistor 954. In this example, the first transistor 410-1 is implemented with a PFET having a source coupled to the supply rail 112 and a drain coupled to the drain of transistor 914, the second transistor 410-2 is implemented with a PFET having a source coupled to the supply rail 112 and a drain coupled to the sources of the input transistors 920 and 922, the third transistor 410-3 is implemented with a PFET having a source coupled to the supply rail 112 and the drain of transistor 950, and the fourth transistor 410-4 is implemented with a PFET having a source coupled to the supply rail 112 and a drain coupled to the source of transistor 954. However, it is to be appreciated that each of the transistors 410-1 to 410-4 may be implemented with another type of transistor in other implementations. The gate of each of the transistors 410-1 to 410-4 is coupled to the gate of the pass device 115 to sense the load current from the gate voltage of the pass device 115, and adjust the respective bias current based on the sensed load current. Thus, the transistors 410-1 to 410-4 provide the amplifying circuit 120 with adaptive current biasing.

In the example in FIG. 9, the transistor 710 shown in FIG. 7 includes a first transistor 710-1 coupled between the supply rail 112 and node 916 of the bias generation circuit 915, a second transistor 710-2 coupled between the supply rail 112 and the sources of the input transistors 920 and 922, a third transistor 710-3 coupled between the supply rail 112 and the drain of transistor 950, and a fourth transistor 710-4 coupled between the supply rail 112 and the source of transistor 954. In the example in FIG. 9, the first transistor 710-1 is implemented with a PFET having a source coupled to the supply rail 112 and a drain coupled to node 916 of the bias generation circuit 915, the second transistor 710-2 is implemented with a PFET having a source coupled to the supply rail 112 and a drain coupled to the sources of the input transistors 920 and 922, the third transistor 710-3 is implemented with a PFET having a source coupled to the supply rail 112 and a drain coupled to the drain of transistor 950, and the fourth transistor 410-4 is implemented with a PFET having a source coupled to the supply rail 112 and a drain coupled to the source of transistor 954. However, it is to be appreciated that each of the transistors 710-1 to 710-4 may be implemented with another type of transistor in other implementations. In this example, the voltage bias circuit 725 is coupled to the gate of each of the transistors 710-1 to 710-4 to bias the gates of the transistors 710-1 to 710-4.

The feedback capacitor 615 is coupled between the output 130 and the gate of each of the transistors 710-1 to 710-4. Thus, the gate of each of the transistors 710-1 to 710-4 is capacitively coupled to the output 130 via the feedback capacitor 615. The capacitive coupling couples a transient voltage drop in the output voltage $V_{out}$ during a voltage undershoot to the gates of the transistors 710-1 to 710-4. In response to the transient voltage drop, each of the transistors 710-1 to 710-4 boosts (i.e., increases) the respective bias current. Thus, in this example, the transistors 710-1 to 710-4 provide dynamic current biasing for the amplifying circuit 120.

Figure 10:
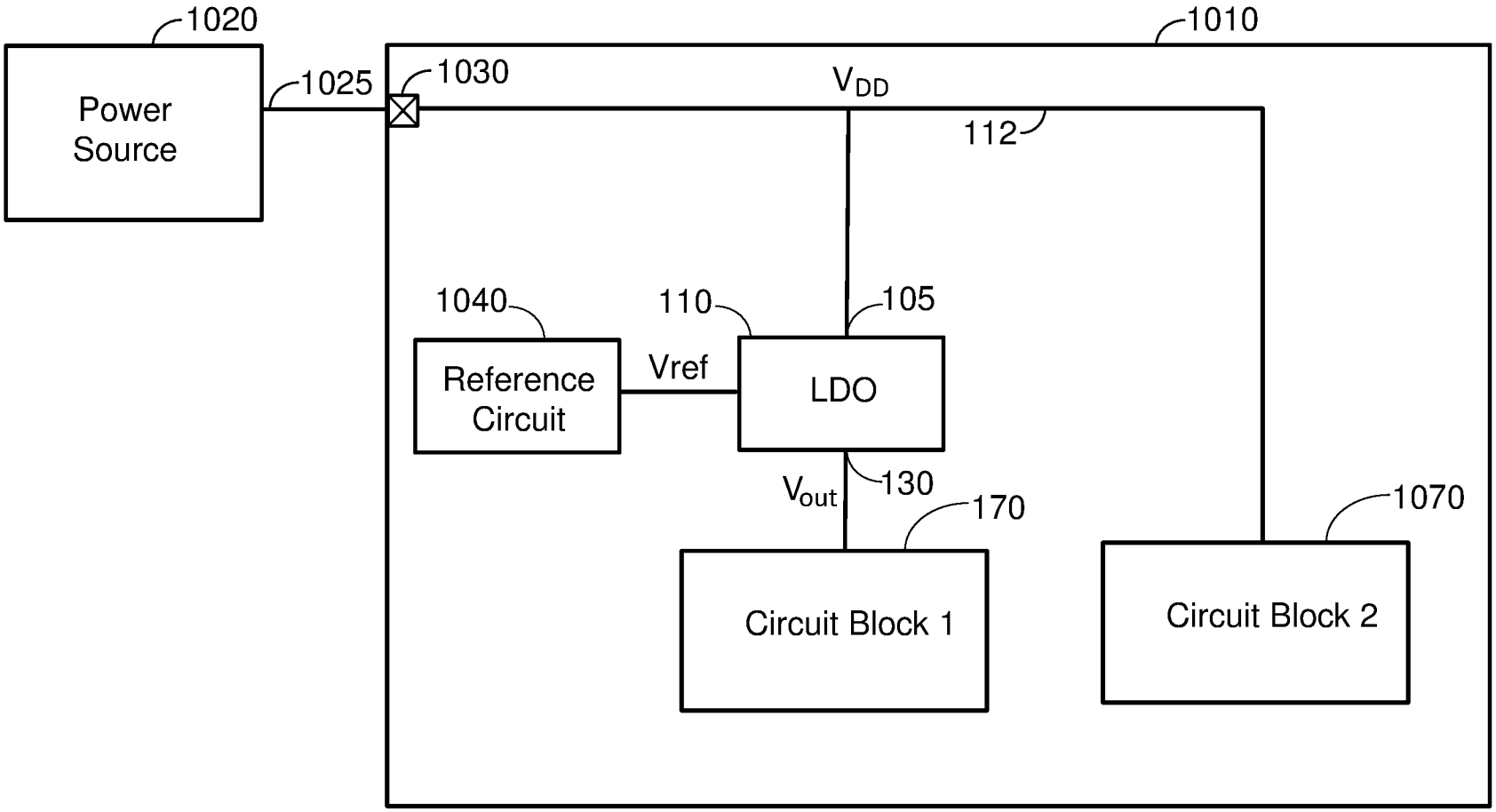
FIG. 10 shows an example of a chip including an LDO regulator according to certain aspects of the present disclosure.

FIG. 10 shows an example of a chip 1010 including the LDO regulator 110 according to certain aspects of the present disclosure. The LDO regulator 110 may be implemented using any of the exemplary implementations shown in FIGS. 6 to 9. The chip 1010 includes the supply rail 112, the circuit block 170, a supply pad 1030, a reference circuit 1040, and a second circuit block 1070. In the discussion below, the circuit block 170 is referred to as the first circuit block 170.

In this example, the supply pad 1030 is coupled to an external power source 1020 (i.e., an off-chip power source). The power source 1020 may include a battery, a power management integrated circuit (PMIC), and/or another power source. For the example in which the power source 1020 includes a PMIC, the PMIC may include a voltage regulator (not shown) configured to convert a voltage from a battery to the supply voltage $V_{DD}$. The supply pad 1030 may be coupled to the power source 1020 via a metal line 1025 (e.g., on a printed circuit board).

The supply rail 112 is coupled to the supply pad 1030. In certain aspects, the supply rail 112 is configured to receive the supply voltage $V_{DD}$ from the power source 1020 via the supply pad 1030. The supply rail 112 may include one or more metal layers on the chip 1010. The supply rail 112 may also include one or more vias and/or one or more other metal interconnect structures for coupling the one or more metal layers.

In this example, the input 105 of the LDO regulator 110 is coupled to the supply rail 112 and the output 130 of the LDO regulator 110 is coupled to the first circuit block 170. The LDO regulator 110 receives the supply voltage $V_{DD}$ at the input 105 and generates the regulated output voltage $V_{out}$ at the output 130 from the supply voltage $V_{DD}$, as discussed above. The output voltage $V_{out}$ is provided to the first circuit block 170 to power the first circuit block 170. The circuit block 170 may include a pad driver, a logic circuit (e.g., combinational logic and/or sequential logic), a processor, a memory, and/or another type of circuit.

The reference circuit 1040 is coupled to the first input 122 of the amplifying circuit 120 (not shown in FIG. 10) in LDO regulator 110. The reference circuit 1040 is configured to generate the reference voltage Vref and output the reference voltage Vref to the first input 122 of the amplifying circuit 120. As discussed above, the LDO regulator 100 regulates the voltage at the output 130 based on the reference voltage and the feedback voltage Vfb. The reference circuit 1040 may be implemented with a voltage divider, a bandgap reference circuit, or any combination thereof.

In this example, the second circuit block 1070 is coupled to the supply rail 112 and receives the supply voltage $V_{DD}$ from the supply rail 112. Thus, in this example, the first circuit block 170 and the second circuit block 1070 are powered by different voltages. More particularly, the first circuit block 170 is power by the regulated output voltage $V_{out}$ of the LDO regulator 110 and the second circuit 1070 is powered by the supply voltage $V_{DD}$ from the supply rail 112. In this example, the LDO regulator 110 allows the first circuit block 170 to be powered by a voltage that is different from the supply voltage $V_{DD}$ on the supply rail 112.

Figure 11:
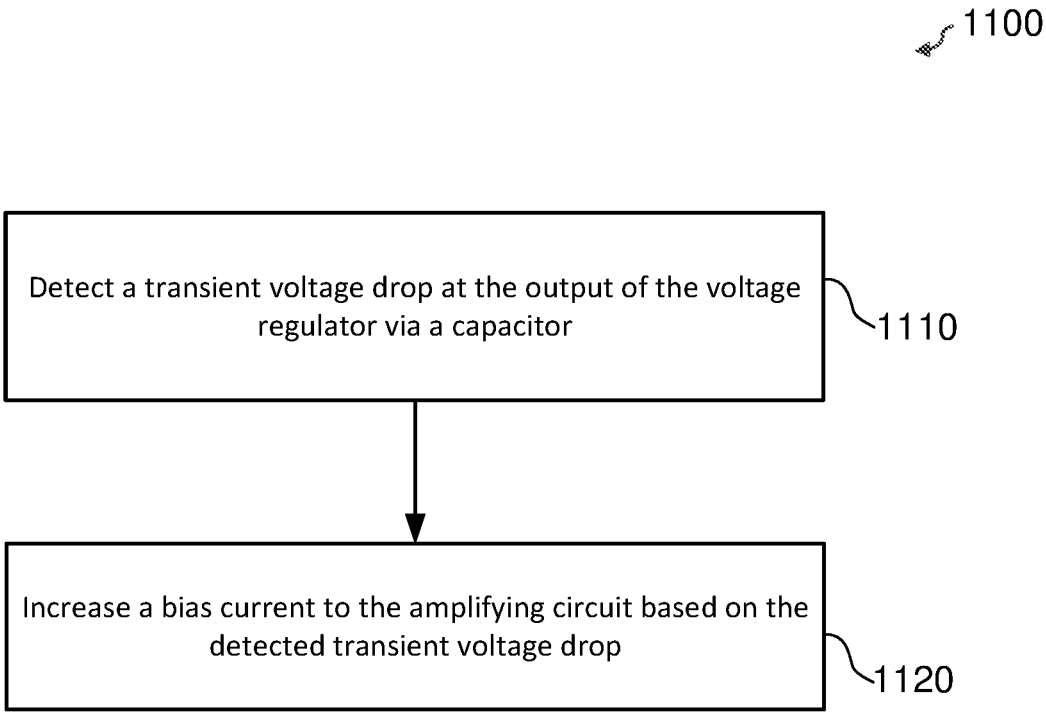
FIG. 11 is a flowchart illustrating a method of operating a voltage regulator according to certain aspects of the present disclosure.

FIG. 11 illustrates a method 1100 of operating a voltage regulator according to certain aspects. The voltage regulator (e.g., LDO regulator 110) includes a pass device (e.g., pass device 115) coupled between an input of the voltage regulator and an output of the voltage regulator, and an amplifying circuit (e.g., amplifying circuit 120) coupled to a gate of the pass device.

At block 1110, a transient voltage drop at the output of the voltage regulator is detected via a capacitor. The capacitor may correspond to the feedback capacitor 615. The transient voltage drop may have a time duration between ten nanoseconds and one microsecond.

At block 1120, a bias current to the amplifying circuit is increased based on the detected transient voltage drop. In one example, the voltage regulator may include a transistor (e.g., transistor 710) coupled between a supply rail (e.g., supply rail 112) and the amplifying circuit. In this example, increasing the bias current to the amplifying circuit may include capacitively coupling the transient voltage drop to a gate of the transistor via the capacitor. In one example, the transistor may include a PFET having a source coupled to the supply rail and a drain coupled to the amplifying circuit.

Implementation examples are described in the following numbered clauses:

1. A voltage regulator, comprising:

a pass device coupled between an input of the voltage regulator and an output of the voltage regulator;

an amplifying circuit having a first input, a second input, and an output, wherein the first input is configured to receive a reference voltage, the second input is coupled to the output of the voltage regulator via a feedback path, and the output of the amplifying circuit is coupled to a gate of the pass device;

a first current source coupled between a supply rail and the amplifying circuit; and a capacitor coupled between the first current source and the output of the voltage regulator.

2. The voltage regulator of clause 1, wherein the first current source comprises a transistor coupled between the supply rail and the amplifying circuit, wherein the capacitor is coupled between a gate of the transistor and the output of the voltage regulator.

3. The voltage regulator of clause 2, wherein the transistor comprises a p-type field effect transistor (PFET) having a source coupled to the supply rail and a drain coupled to the amplifying circuit.

4. The voltage regulator of clause 2 or 3, further comprising a voltage bias circuit coupled to the gate of the transistor.

5. The voltage regulator of any one of clauses 1 to 4, further comprising a second current source coupled between the supply rail and the amplifying circuit, wherein the second current source is coupled to the gate of the pass device.

6. The voltage regulator of clause 5, wherein:

the first current source comprises a first transistor coupled between the supply rail and the amplifying circuit, wherein the capacitor is coupled between a gate of the first transistor and the output of the voltage regulator; and the second current source comprises a second transistor coupled between the supply rail and the amplifying circuit, wherein a gate of the second transistor is coupled to the gate of the pass device.

7. The voltage regulator of clause 6, wherein:

the first transistor comprises a first p-type field effect transistor (PFET) having a source coupled to the supply rail and a drain coupled to the amplifying circuit; and the second transistor comprises a second PFET having a source coupled to the supply rail and a drain coupled to the amplifying circuit.

8. The voltage regulator of clause 6 or 7, further comprising a voltage bias circuit coupled to the gate of the first transistor.

9. The voltage regulator of any one of clauses 1 to 8, wherein the amplifying circuit comprises:

an amplifier having a first input configured to receive the reference voltage, a second input coupled to the output of the voltage regulator via the feedback path, and an output; and a buffer having an input coupled to the output of the amplifier, and an output coupled to the gate of the pass device.

10. The voltage regulator of clause 9, wherein the first current source comprises:

a first transistor coupled between the supply rail and the amplifier, wherein the capacitor is coupled between a gate of the first transistor and the output of the voltage regulator; and a second transistor coupled between the supply rail and the buffer, wherein the capacitor is coupled between a gate of the second transistor and the output of the voltage regulator.

11. The voltage regulator of clause 10, wherein:

the first transistor comprises a first p-type field effect transistor (PFET) having a source coupled to the supply rail and a drain coupled to the amplifier; and the second transistor comprises a second PFET having a source coupled to the supply rail and a drain coupled to the buffer.

12. The voltage regulator of clause 10 or 11, further comprising a voltage bias circuit coupled to the gate of the first transistor and the gate of the second transistor.

13. The voltage regulator of any one of clauses 9 to 12, further comprising a second current source coupled between the supply rail and the amplifying circuit, wherein the second current source is coupled to the gate of the pass device.

14. The voltage regulator of clause 13, wherein the second current source comprises:

a third transistor coupled between the supply rail and the amplifier, wherein a gate of the third transistor is coupled to the gate of the pass device; and a fourth transistor coupled between the supply rail and the buffer, wherein a gate of the third transistor is coupled to the gate of the pass device.

15. The voltage regulator of any one of clauses 9 to 14, wherein the amplifier comprises a cascode amplifier.

16. The voltage regulator of any one of clauses 9 to 15, further comprising a bias generation circuit, wherein the bias generation circuit includes:

a resistor coupled between a first node and a second node, wherein the first node is coupled to a bias input of the amplifier;

a capacitor coupled between the first node and the second node; and a bias transistor having a drain coupled to the second node, a gate coupled to the drain, and a source coupled to a ground.

17. The voltage regulator of clause 16, wherein the first current source comprises:

a first transistor coupled between the supply rail and the first node of the bias generation circuit, wherein the capacitor is coupled between a gate of the first transistor and the output of the voltage regulator;

a second transistor coupled between the supply rail and the amplifier, wherein the capacitor is coupled between a gate of the second transistor and the output of the voltage regulator; and a third transistor coupled between the supply rail and the buffer, wherein the capacitor is coupled between a gate of the third transistor and the output of the voltage regulator.

18. The voltage regulator of clause 17, further comprising a voltage bias circuit coupled to the gate of the first transistor, the gate of the second transistor, and the gate of the third transistor.

19. The voltage regulator of any one of clauses 9 to 18, wherein the buffer comprises a source follower.

20. A method of operating a voltage regulator, wherein the voltage regulator includes a pass device coupled between an input of the voltage regulator and an output of the voltage regulator, and an amplifying circuit coupled to a gate of the pass device, the method comprising:

detecting a transient voltage drop at the output of the voltage regulator via a capacitor; and increasing a bias current to the amplifying circuit based on the detected transient voltage drop.

21. The method of clause 20, wherein:

the voltage regulator includes a transistor coupled between a supply rail and the amplifying circuit; and increasing the bias current to the amplifying circuit based on the transient voltage drop comprises capacitively coupling the transient voltage drop to a gate of the transistor via the capacitor.

22. The method of clause 21, wherein the transistor comprises a first p-type field effect transistor (PFET) having a source coupled to the supply rail and a drain coupled to the amplifying circuit.

23. The method of any one of clauses 20 to 22, further comprising:

detecting a gate voltage of the pass device; and adjusting the bias current to the amplifying circuit based on the detected gate voltage.

24. The method of clause 23, wherein:

the voltage regulator includes a first transistor coupled between a supply rail and the amplifying circuit;

increasing the bias current to the amplifying circuit based on the transient voltage drop comprises capacitively coupling the transient voltage drop to a gate of the first transistor via the capacitor;

the voltage regulator includes a second transistor coupled between the supply rail and the amplifying circuit; and adjusting the bias current to the amplifying circuit based on the detected gate voltage comprises coupling a gate of the second transistor to the gate of the pass device.

25. A chip, comprising:

a pad;

a supply rail coupled to the pad;

a reference circuit configured to generate a reference voltage; and a voltage regulator comprising:

a pass device coupled between an input of the voltage regulator and an output of the voltage regulator, wherein the input of the voltage regulator is coupled to the supply rail;

an amplifying circuit having a first input, a second input, and an output, wherein the first input is coupled to the reference circuit, the second input is coupled to the output of the voltage regulator via a feedback path, and the output of the amplifying circuit is coupled to a gate of the pass device;

a first current source coupled between the supply rail and the amplifying circuit; and a capacitor coupled between the first current source and the output of the voltage regulator.

26. The chip of clause 25, wherein the first current source comprises a transistor coupled between the supply rail and the amplifying circuit, wherein the capacitor is coupled between a gate of the transistor and the output of the voltage regulator.

27. The chip of clause 26, further comprising a voltage bias circuit coupled to the gate of the transistor.

28. The chip of any one of clauses 25 to 27, further comprising a second current source coupled between the supply rail and the amplifying circuit, wherein the second current source is coupled to the gate of the pass device.

29. The chip of clause 28, wherein:

the first current source comprises a first transistor coupled between the supply rail and the amplifying circuit, wherein the capacitor is coupled between a gate of the first transistor and the output of the voltage regulator; and the second current source comprises a second transistor coupled between the supply rail and the amplifying circuit, wherein a gate of the second transistor is coupled to the gate of the pass device.

30. The chip of clause 29, wherein:

the first transistor comprises a first p-type field effect transistor (PFET) having a source coupled to the supply rail and a drain coupled to the amplifying circuit; and the second transistor comprises a second PFET having a source coupled to the supply rail and a drain coupled to the amplifying circuit.

Any reference to an element herein using a designation such as "first," "second," and so forth does not generally limit the quantity or order of those elements. Rather, these designations are used herein as a convenient way of distinguishing between two or more elements or instances of an element. Thus, a reference to first and second elements does not mean that only two elements can be employed, or that the first element must precede the second element.

Within the present disclosure, the word "exemplary" is used to mean "serving as an example, instance, or illustration." Any implementation or aspect described herein as "exemplary" is not necessarily to be construed as preferred or advantageous over other aspects of the disclosure. Likewise, the term "aspects" does not require that all aspects of the disclosure include the discussed feature, advantage or mode of operation. The term "approximately", as used herein with respect to a stated value or a property, is intended to indicate being within 10% of the stated value or property (i.e., between 90% to 110% of the stated value or property).

The previous description of the disclosure is provided to enable any person skilled in the art to make or use the disclosure. Various modifications to the disclosure will be readily apparent to those skilled in the art, and the generic principles defined herein may be applied to other variations without departing from the spirit or scope of the disclosure. Thus, the disclosure is not intended to be limited to the examples described herein but is to be accorded the widest scope consistent with the principles and novel features disclosed herein.

What is claimed is:

1. A voltage regulator, comprising:

a pass device coupled between an input of the voltage regulator and an output of the voltage regulator;

an amplifying circuit having a first input, a second input, and an output, wherein the first input is configured to receive a reference voltage, the second input is coupled to the output of the voltage regulator via a feedback path, and the output of the amplifying circuit is coupled to a gate of the pass device;

a first current source coupled between a supply rail and the amplifying circuit, wherein the first current source comprises a first transistor coupled between the supply rail and the amplifying circuit and a drain of the first transistor is coupled directly to the amplifying circuit, wherein a capacitor is coupled between a gate of the first transistor and the output of the voltage regulator;

a second current source coupled between the supply rail and the amplifying circuit, wherein the second current source comprises a second transistor coupled between the supply rail and the amplifying circuit, a gate of the second transistor is coupled to the gate of the pass device, and a drain of the second transistor is coupled directly to the amplifying circuit.

2. The voltage regulator of claim 1, wherein the first transistor comprises a p-type field effect transistor (PFET) having a source coupled to the supply rail.

3. The voltage regulator of claim 1, further comprising a voltage bias circuit coupled to the gate of the first transistor.

4. The voltage regulator of claim 1, wherein the amplifying circuit comprises:

an amplifier having the first input configured to receive the reference voltage, the second input coupled to the output of the voltage regulator via the feedback path, and the output; and a buffer having an input coupled to the output of the amplifier, and an output coupled to the gate of the pass device.

5. The voltage regulator of claim 4, wherein the first current source further comprises:

a third transistor coupled between the supply rail and the buffer, wherein the capacitor is coupled between a gate of the third transistor and the output of the voltage regulator.

6. The voltage regulator of claim 5, wherein:

the first transistor comprises a first p-type field effect transistor (PFET) having a source coupled to the supply rail and a drain coupled to the amplifier; and the third transistor comprises a second PFET having a source coupled to the supply rail and a drain coupled to the buffer.

7. The voltage regulator of claim 5, further comprising a voltage bias circuit coupled to the gate of the first transistor and the gate of the third transistor.

8. The voltage regulator of claim 5, wherein the second current source further comprises:

a fourth transistor coupled between the supply rail and the buffer, wherein a gate of the fourth transistor is coupled to the gate of the pass device.

9. The voltage regulator of claim 4, wherein the amplifier comprises a cascode amplifier.

10. The voltage regulator of claim 4, further comprising a bias generation circuit, wherein the bias generation circuit includes:

a resistor coupled between a first node and a second node, wherein the first node is coupled to a bias input of the amplifier;

a capacitor coupled between the first node and the second node; and a bias transistor having a drain coupled to the second node, a gate coupled to the drain, and a source coupled to a ground.

11. The voltage regulator of claim 4, wherein the buffer comprises a source follower.

12. A chip, comprising:

a pad;

a supply rail coupled to the pad;

a reference circuit configured to generate a reference voltage; and the voltage regulator of claim 1.

13. A method of operating a voltage regulator, wherein the voltage regulator includes a pass device coupled between an input of the voltage regulator and an output of the voltage regulator, and an amplifying circuit coupled to a gate of the pass device, the method comprising:

detecting a transient voltage drop at the output of the voltage regulator via a capacitor;

increasing a bias current to the amplifying circuit based on the detected transient voltage drop;

detecting a gate voltage of the pass device; and adjusting the bias current to the amplifying circuit based on the detected gate voltage, wherein:

the voltage regulator includes a first transistor coupled between a supply rail and the amplifying circuit, wherein a drain of the first transistor is directly coupled to the amplifying circuit;

increasing the bias current to the amplifying circuit based on the transient voltage drop comprises capacitively coupling the transient voltage drop to a gate of the first transistor via the capacitor, wherein:

the voltage regulator includes a second transistor coupled between the supply rail and the amplifying circuit, wherein a drain of the second transistor is directly coupled to the amplifying circuit, and a gate of the second transistor is coupled to the gate of the pass device; and adjusting the bias current to the amplifying circuit based on the detected gate voltage comprises coupling a gate of the second transistor to the gate of the pass device.

14. The method of claim 13, further comprising:

increasing the bias current to the amplifying circuit based on the transient voltage drop comprises capacitively coupling the transient voltage drop to a gate of the first transistor via the capacitor.

15. The method of claim 14, wherein the transistor comprises a first p-type field effect transistor (PFET).

* * * * *